United States Patent [19]

Kroh

[11] Patent Number: 4,479,339

[45] Date of Patent: Oct. 30, 1984

[54] COVER MEMBER FOR AND METHOD OF INSTALLING INSULATION BOARDS

[75] Inventor: Carl A. Kroh, Clearwater, Fla.

[73] Assignee: The Celotex Corporation, Tampa, Fla.

[21] Appl. No.: 366,435

[22] Filed: Apr. 7, 1982

[51] Int. Cl.[3] ..... E04D 1/36; E04B 1/82

[52] U.S. Cl. ..... 52/468; 52/144; 52/747

[58] Field of Search ..... 52/465, 459, 460, 461, 52/144, 488, 481, 468, 471, 823, 400, 403, 824, 825, 745, 746, 747

[56] References Cited

U.S. PATENT DOCUMENTS

| | | | |
|---|---|---|---|
| 1,974,819 | 9/1934 | Koerner | 72/118 |
| 2,340,911 | 2/1944 | Urbain | 52/488 |
| 3,162,906 | 12/1964 | Dudley | 52/403 |
| 3,171,886 | 3/1965 | Holt et al. | 52/400 |
| 3,271,920 | 9/1966 | Downing, Jr. | 52/735 |
| 3,313,076 | 4/1967 | MacDonald | 52/144 |
| 3,421,281 | 1/1969 | Harris | 52/488 |
| 3,514,916 | 6/1970 | Hoverman | 52/400 |
| 3,545,154 | 12/1970 | Bobzin | 52/460 |
| 3,609,933 | 10/1971 | Jahn et al. | 52/461 |
| 3,766,697 | 10/1973 | Jackson | 52/400 |
| 3,807,114 | 4/1974 | Ollinger | 52/144 |
| 4,014,150 | 3/1977 | Wells et al. | 52/461 |
| 4,047,346 | 9/1977 | Alderman | 52/488 |
| 4,184,297 | 1/1980 | Casamoyer | 52/403 |

FOREIGN PATENT DOCUMENTS

| | | | |
|---|---|---|---|
| 449223 | 6/1948 | Canada | 52/465 |
| 1500668 | 9/1967 | France | 52/465 |

*Primary Examiner*—John E. Murtagh
*Assistant Examiner*—Andrew Joseph Rudy
*Attorney, Agent, or Firm*—James W. Grace; Charles W. Vanecek

[57] ABSTRACT

The present invention is directed to a novel cover member for insulation boards and a novel method of installing such boards in which said cover member is generally of inverted T-shaped configuration with an added strip extending outwardly from the vertical web of said cover member to confine one edge of an insulation board. The method of installation is a progressive step method, using the novel cover members of the invention.

8 Claims, 4 Drawing Figures

COVER MEMBER FOR AND METHOD OF INSTALLING INSULATION BOARDS

BACKGROUND OF THE INVENTION

Field of the Invention

As in most structures, so in pre-engineered metal buildings, energy savings have become more of a consideration than in the past. This emphasis on energy savings has resulted in the use of insulation boards to cover otherwise exposed framing members in such buildings.

Metal building roofs may be constructed of metal sheets which are attached to metal roof purlins. Purlins or metal framing members are installed at spaced intervals across the top of the building to lend structural support. These purlins extend in generally parallel rows from one wall to another below the roof support system or the purlins may be part of the roof support system. The roof purlins, therefore, form a series of spaced parallel strips to which insulation boards may be attached.

To save installation time, the insulation boards are sometimes long enough to span the building from one side to the other in parallel, longitudinal, edge-to-edge abutment so that a lesser number of boards will be needed to cover the purlins in installing a ceiling in the building. It is desirable that the fewest possible number of workers be used for this installation so that a simple means for installing the boards must be devised. The simplest type of components must be used to accomplish the installation.

It has been found objectionable from an aesthetic viewpoint to have exposed edges or gaps between adjacemt insulation boards so that cover strips should be provided to hide such exposed edges. In the past, adhesive strips have been placed over the gaps at adjacent edges of insulation boards but the adhesive strips have proven to be unsightly and require additional labor to install since they must be put up after the insulation boards are put in place.

If a cover member of inverted "T" configuration were used, the cover member may sag between spaced purlins and an unsightly gap may form between the cover member and the edge of the insulation boards which the cover member is designed to hide. If the inverted "T" shaped cover member is made stiff enough not to deflect, the additional material required raises its costs.

In addition, since one of the objectives of the installation is energy savings, it is desirable to have as little air movement through the ceiling as possible. Sealants or caulking should be used to prevent air movement through the system.

SUMMARY OF THE INVENTION

This invention relates to a simple device useful in installing insulation boards in a metal building and a progressive method for accomplishing such installation.

It is an object of this invention to provide a novel longitudinal cover member for use in installing a ceiling of insulation boards.

It is another object of this invention to provide a novel longitudinal cover member for use in installing insulation boards with a minimum of destruction or injury to the insulation boards.

It is yet another object of this invention to provide a novel method of installing a ceiling of insulation boards in a quick and efficient manner.

It is still another object of the invention to provide an easy method of putting cover strips in place to hide the gaps between adjacent insulation boards and leave an aesthetically pleasing appearance.

Other objects and advantages of the present invention will become apparent to those skilled in the art from a consideration of the attached drawing in which like numerals indicate like elements and in which.

Figure 1:
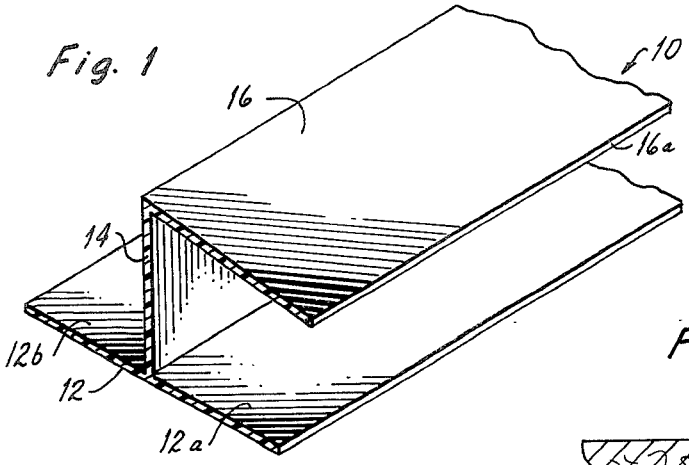
FIG. 1 is a perspective view of the cover member of the invention.

Referring now to FIG. 1, there is shown a longitudinal cover member 10 of indefinite length having a first elongated strip 12 of stiff material which forms a base for said cover member. Said base 12 has right and left extensions **12*a* and 12*b* respectively. A vertical web 14 extends upwardly along the longitudinal axis of strip 12. Generally, the height of web 14 is about the same as the thickness of the insulation board with which said cover member is to be used. Extending to the right from said web is a second strip 16 of stiff material integrally connected to said vertical web 14 along its length. Strip 16 extends in an overlying configuration with respect to extension 12*a* of first strip 10 and having a portion spaced therefrom a distance slightly less than the height of web 14. Strip 16 and extension 12*a* of first elongated strip 12 are inclined slightly toward each other so that they will grip tightly an insulation board which has a thickness about equal to the height of web 14. It is clear that either or both strip 16 and extension 12*a*** may be inclined toward each other.

The length of cover member 10 is indefinite and may be long enough to span the full length or width of the building in a direction perpendicular to that of the purlins.

Cover member 10 may be made of thin metal, such as sheet aluminum, or a plastic material, such as polypropylene, polystyrene or polyvinyl chloride. The strips and web of member 10 need only be of sufficient thickness to keep its configuration.

The preferred insulation board is Thermax insulation board manufactured and sold by The Celotex Corporation. Thermax insulation board is an insulation board produced by a patented process and comprises a glass reinforced polyisocyanurate foam plastic core with aluminum foil facers. The insulation board may vary from about ½" in thickness to greater than 1" in thickness depending upon the desired insulation value. Generally the insulation board is made in widths of 4 feet and of lengths varying up to 20 feet. Although longer lengths may be purchased on special order. Such board is made by the process described in U.S. Pat. Nos. 4,028,158 and 4,118,533.

Other suitable insulation boards may be rigid urethane or polystyrene boards with or without suitable facers.

Figure 2:
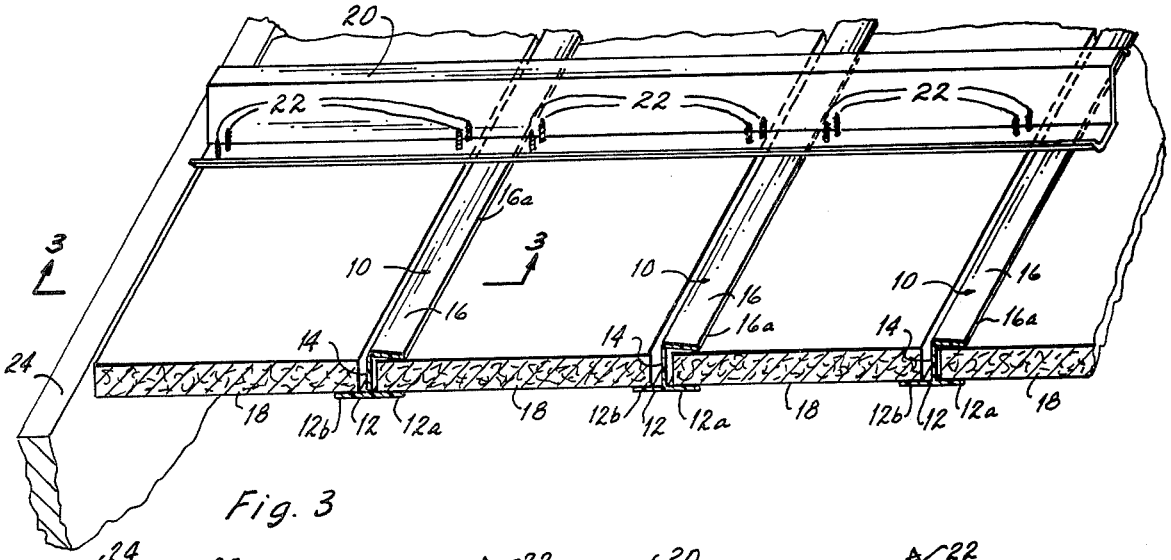
FIG. 2 is a perspective view of a portion of a ceiling showing the cover member in conjunction with insulation boards in a preferred configuration.
Figure 3:
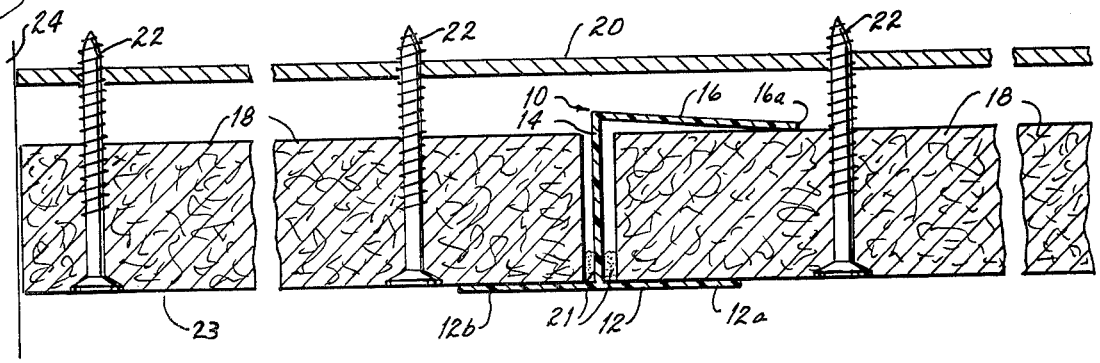
FIG. 3 is an end elevation taken along line 3—3 of FIG. 2.

With reference to FIG. 2, there is therein shown a perspective view of a portion of a ceiling showing cover member 10 in conjunction with insulation boards 18. Insulation boards 18 are secured to purlins 20 by screws or fasteners 22 located in the exposed field areas 23 of the insulation board. The insulation board 18 at the left-hand of FIG. 2 contacts extension 12*b* of strip 12 of member 10. As may be seen, the insulation board 18 at the left hand of FIG. 2 is not covered by second strip 16. The insulation board 18 in the center of FIG. 2 is held between extension 12*a* of strip 12 and strip 16 of member 10 along its left-hand edge, but the right-hand edge of this insulation board is free of restraint by overlying strips.

If desired, caulking or sealing material 21, such as putty, may be placed along each side of the joint of web 14 and strip 12 to form an air-tight seal between the suspension member 10 and the insulation board 18. In this way there is no air movement through the ceiling formed by the insulation board 18 and the cover members 10.

The method of installing the insulation board may be described as a progressive installation in that the insulation boards are installed from left to right in progressive steps. The advantage of this sytem is that it permits one installer to put up the entire ceiling with a minimum of effort and requires no additional help.

First, the left-most insulation board 18 is installed using sufficient fasteners 22 to hold the insulation board tightly against the underside of purlins 20. Insulation board 18 is placed snuggly against the left wall 24 of the building and is selected to be long enough to span from one edge of the building to the other across the purlins 20. Thus, when installed, the first insulation board is perpendicular to the longitudinal direction of the purlins 20 and forms a strip about 4 feet wide away from the left wall of the building. The installer may place a bead of sealant 21 along each side of the juncture of vertical web 14 and first strip 12. The installer then attaches cover member 10 along the left edge of the next insulation board 18 until the cover member 10 fits snuggly along that edge. Preferably, this operation is performed while the installer is still on the floor of the building where it is simple to slip the cover member 10 over the left-hand edge of insulation board 18. The left-hand strip 12*b* of the elongated strip 12 extends outwardly and is free to be fitted against the underside of insulation board 18 which has been previously attached to the purlins by fasteners 22.

The installer then climbs upon a ladder or scaffold where he places the insulation board to which he has just attached cover member 10 against the underside of purlins 20 with extension 12*b* of strip 12 overlying the free right-hand edge of the previously installed insulation board.

One of the features of this invention lies in the absence of an upper strip extending perpendicularly from the top of the web 14 to the left. If such a strip were present, it would be difficult to attach the cover member 10 to the right-hand edge of the board which is already fixed in place without damage to the edge of the board.

In the present invention it is simple to install the next insulation board by fitting the left extension 12*b* of the first elongated strip 12 against the lower surface and right-hand edge of the insulation board which has been previously installed.

Each insulation board is individually secured to the purlins before the next insulation board is brought into place. The steps of installation are repeated in sequence until the last insulation board is put in place. It may be necessary to cut the last insulation board so that it may be fitted into place, but the cutting can be done before the board is raised into place.

It is clear that the installation of the cover strip is done with the same operation that puts the insulation board in place and does not require that the installer add the additional step of putting up an adhesive strip to hide the gaps between adjacent insulation boards.

Figure 4:
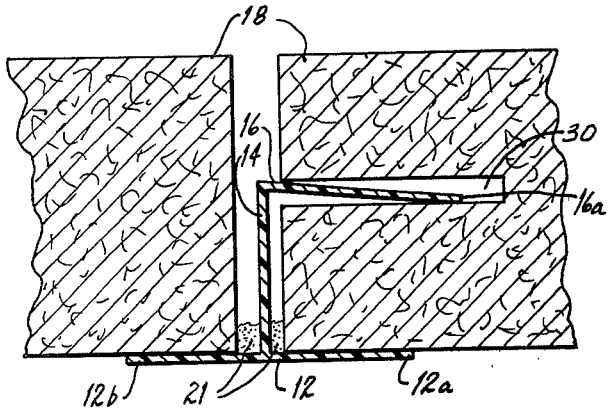
FIG. 4 is a fragmentary view of the edge configuration of alternative insulation boards using the novel cover member of the invention.

For an alternate arrangement showing the use of cover member 10, reference may be had to FIG. 4 which illustrates cover member 10 in conjunction with boards which are thicker than the height of web 14. In this case, the thicker insulation board 18 at the right has a kerf or longitudinal cut 30 which is displaced from the face of insulation board 18 a distance equal to the height of web 14 so that again cover member 10 may be securely held in place with respect to the insulation board. The method of installation of this alternate version is the same as that previously described.

While the invention has been illustrated and described with the insulation board attached to the underside of the purlins, it should be understood that the insulation boards can be secured to the upper face of the purlins wherein the insulation board lies in a plane above the purlins. The cover member 10 is applied in the same place and in the same manner as before with respect to the insulation boards. In this latter construction, the cover member spans between parallel spaced purlins, but the cover member is again given added strength by being secured along at least one edge of an insulation board. Thus, the invention is not to be limited to a structure in which the insulation boards are applied solely from underneath the purlins.

What has been described is a novel cover member 10 for insulation boards 18 and a novel method of installing such insulation boards, but it should be understood that the invention is not to be limited thereto, as many modifications may be made. It is, therefore, contemplated to cover by the present application any and all such modifications as fall within the true spirit and scope of the appended claims.

I claim:

1. A suspended ceiling consisting essentially of spaced parallel purlins supported above an open space, adjacently lying insulation boards having exposed field areas secured to said purlins, said insulation boards being oriented so that their longitudinal axes are perpendicular to the longitudinal axes of said purlins, fasteners penetrating said insulation boards and said purlins, said fasteners being located in the exposed field areas of said insulation boards, cover members inserted between said adjacently lying insulation boards and away from said fasteners, said cover members consisting essentially of:

a first elongated strip of stiff material;

a web of stiff material integrally connected to said first elongated strip and extending substantially vertically upwardly along the longitudinal center line of said first elongated strip, and terminating in an upper edge, and a second strip of stiff material integrally connected along said upper edge of said vertically extending web, said second strip extending in overlying relation in one direction only with respect to said first elongated strip, said second strip further being inclined at an acute angle with respect to said vertically extending web and having a portion which is spaced from said first elongated strip by a predetermined distance, said distance being less than the height of said web, each of said cover members being secured along one edge of one of said insulation boards.

2. A suspended ceiling as recited in claim 1 in which a sealing compound is placed along each side of the base of said vertical web and in sealing contact with edges of adjacent insulation boards.

3. A suspended ceiling consisting essentially of spaced parallel purlins supported above an open space, adjacently lying insulation boards having exposed field areas secured to said purlins in a plane below said spaced parallel purlins, said insulation boards being oriented so that their longitudinal axes are perpendicular to the longitudinal axes of said purlins, fasteners penetrating said insulation boards and said purlins, said fasteners being located in the exposed field areas of said insulation boards, cover members inserted between said adjacently lying insulation boards and away from said fasteners, said cover members consisting essentially of:

a first elongated strip of stiff material;

a web of stiff material integrally connected to said first elongated strip and extending substantially vertically upwardly along the longitudinal center line of said first elongated strip, and terminating in an upper edge, and a second strip of stiff material integrally connected along said upper edge of said vertically extending web, said second strip extending in overlying relation in one direction only with respect to said first elongated strip, said second strip further being inclined at an acute angle with respect to said vertically extending web and having a portion which is spaced from said first elongated strip by a predetermined distance, said distance being less than the height of said web, each of said cover members being secured along one edge of one of said insulation boards.

4. A suspended ceiling consisting essentially of spaced parallel purlins supported above an open space, adjacently lying insulation boards having exposed field areas secured to said purlins in a plane above said spaced parallel purlins, said insulation boards being oriented so that their longitudinal axes are perpendicular to the longitudinal axes of said purlins, fasteners penetrating said insulation boards and said purlins, said fasteners being located in the field areas of said insulation boards, cover members inserted between said adjacently lying insulation boards and away from said fasteners, said cover members consisting essentially of:

a first elongated strip of stiff material;

a web of stiff material integrally connected to said first elongated strip and extending substantially vertically upwardly along the longitudinal center line of said first elongated strip, and terminating in an upper edge, and a second strip of stiff material integrally connected along said upper edge of said vertically extending web, said second strip extending in overlying relation in one direction only with respect to said first elongated strip, said second strip further being inclined at an acute angle with respect to said vertically extending web and having a portion which is spaced from said first elongated strip by a predetermined distance, said distance being less than the height of said web, each of said cover members being secured along one edge of one of said insulation boards.

5. The method of installing a suspended ceiling of insulation boards having exposed field areas to overhead purlins in a building, wherein the purlins are in spaced, parallel relationship the steps of 1. securing a first one of said insulating boards to said purlins along one side of said building with the longitudinal axis of said insulation board being perpendicular to the longitudinal axis of said purlins, by fasteners located in the exposed field areas of said insulating board and away from the longitudinal edges of said insulating board, 2. affixing to one edge of a second insulation board a cover member, said cover member consisting essentially of:

a first elongated strip of stiff material;

a web of stiff material integrally connected to said first elongated strip and extending substantially vertically upwardly along the longitudinal center line of said first elongated strip, and terminating in an upper edge, and a second strip of stiff material integrally connected along said upper edge of said vertically extending web, said second strip extending in overlying relation in one direction only with respect to said first elongated strip, further being inclined at an acute angle with respect to said vertically extending web and said second strip having a portion which is spaced from said first elongated strip by a predetermined distance, said distance being less than the height of said web, 3. placing said second insulation member against the said purlins with a portion of said strip of said cover member covering an edge of said first one of said insulation boards adjacent an edge of said second insulation board, 4. affixing said second insulation board to said purlins by fasteners located in the exposed field area of said insulating boards and away from the longitudinal edges of said second insulation board, and 5. repeating steps 3 and 4 with additional insulation boards and cover members until said ceiling is completed.

6. The method of installing a suspended ceiling of insulation boards to overhead purlins according to claim 5 in which prior to the affixation of said cover member to an insulation board, there in an added step of placing a layer of sealant along each side of the juncture of said vertical web and said first strip of said cover member.

7. The method of installing a suspended ceiling of insulation boards having exposed field areas to overhead purlins in a building, wherein the purlins are in spaced, parallel relationship the steps of 1. securing a first one of said insulation boards to said purlins along one side of said building and to the underside of said purlins with the longitudinal axis of said insulation board being perpendicular to the longitudinal axis of said purlins by fasteners located in the exposed field area of said insulating board and away from the longitudinal edges of said insulating board, 2. affixing to one edge of a second insulation board a cover member, said cover member consisting essentially of:

a first elongated strip of stiff material;

a web of stiff material integrally connected to said first elongated strip and extending substantially vertically upwardly along the longitudinal center line of said first elongated strip, and terminating in an upper edge, and a second strip of stiff material integrally connected along said upper edge of said vertically extending web, said second strip extending in overlying relation in one direction only with respect to said first elongated strip, said second strip further being inclined at an acute angle with respect to said vertically extending web and having a portion which is spaced from said first elongated strip by a predetermined distance, said distance being less than the height of said web, 3. placing said second insulation member against the underside of said purlins with a portion of said strip of said cover members covering an edge of said first one of said insulation boards adjacent an edge of said second insulation board, 4. affixing said second insulation board to said purlins, by fasteners located in the exposed field area of said insulation boards and away from the longitudinal edges of said second insulation board, and 5. repeating steps 3 and 4 with additional insulation boards and cover members until said ceiling is completed.

8. The method of installing a suspended ceiling of insulation boards having field areas to overhead purlins in a building, wherein the purlins are in spaced, parallel relationship the steps of 1. securing a first one of said insulation boards to said purlins along one side of said building and to the upperside of said purlins with the longitudinal axis of said insulation board being perpendicular to the longitudinal axis of said purlins by fasteners located in the field area of said insulation boards and away from the longitudinal edges of said insulating board, 2. affixing to one edge of a second insulation board a cover member, said cover member consisting essentially of:

a first elongated strip of stiff material;

a web of stiff material integrally connected to said first elongated strip and extending substantially vertically upwardly along the longitudinal center line of said first elongated strip, and terminating in an upper edge, and a second strip of stiff material integrally connected along said upper edge of said vertically extending web, said second strip extending in overlying relation in one direction only with respect to said first elongated strip, said second strip further being inclined at an acute angle with respect to said vertically extending web and having a portion which is spaced from said first elongated strip by a predetermined distance, said distance being less than the height of said web, 3. placing said second insulation member against the upperside of said purlins with a portion of said strip of said cover member covering an edge of said first one of said insulation boards adjacent an edge of said second insulation board, 4. affixing said second insulation board to said purlins, by fasteners located in the field area of said insulation boards and away from the longitudinal edges of said second insulation board, and 5. repeating steps 3 and 4 with additional insulation boards and cover members until said ceiling is completed.

* * * * *